United States Patent [19]

Toropainen

[11] 4,200,045

[45] Apr. 29, 1980

[54] LOADING ARRANGEMENT FOR A CYLINDER STACK

[75] Inventor: Jorma Toropainen, Simpele, Finland

[73] Assignee: Oy Wartsila AB, Helsinki, Finland

[21] Appl. No.: 858,021

[22] Filed: Dec. 6, 1977

Related U.S. Application Data

[63] Continuation of Ser. No. 660,313, Feb. 23, 1976, abandoned.

[30] Foreign Application Priority Data

Feb. 27, 1975 [FI] Finland ..... 750566

[51] Int. Cl.[2] ..... B41F 13/20

[52] U.S. Cl. ..... 101/217; 101/153; 100/162 B

[58] Field of Search ..... 101/212, 216–219, 101/153; 100/162 R, 162 B, 170

[56] References Cited

U.S. PATENT DOCUMENTS

| | | | |
|---|---|---|---|
| B 432,991 | 3/1976 | Cumbers | 101/163 R |
| 2,246,077 | 6/1941 | Rogowski | 101/216 |
| 2,851,869 | 9/1958 | Quoos et al. | 100/162 X |
| 3,111,894 | 11/1963 | Murray | 100/162 B |
| 3,179,046 | 4/1965 | Marl et al. | 101/216 |
| 3,196,788 | 7/1965 | Knowles | 101/217 |
| 3,204,552 | 9/1965 | Beachler | 100/170 |
| 3,429,166 | 2/1969 | Baker et al. | 72/242 |
| 3,610,144 | 10/1971 | Woessner | 101/216 |
| 3,732,815 | 5/1973 | Greiner et al. | 101/216 |
| 3,736,869 | 6/1973 | Motter et al. | 101/153 |

FOREIGN PATENT DOCUMENTS 700436 12/1953 United Kingdom ..... 100/162 B

*Primary Examiner*—William Pieprz

*Attorney, Agent, or Firm*—Haseltine, Lake & Waters

[57] ABSTRACT

A loading arrangement for obtaining an equally distributed pressure load in a cylinder stack included in a printing unit of an offset printing press, comprising a plurality of cylinders each having a cylindrical body portion and stub shafts at both ends, journalled in bearings. The arrangement includes axially short load rollers for producing a pressure load to the outermost cylinders of the stack. The rollers are located to act on portions between the bearings of the cylinders, and hence, the pressure load is transmitted directly to the body portions of the outermost cylinders. This minimizes the deflection of the cylinders.

4 Claims, 2 Drawing Figures

LOADING ARRANGEMENT FOR A CYLINDER STACK

Figure 1:
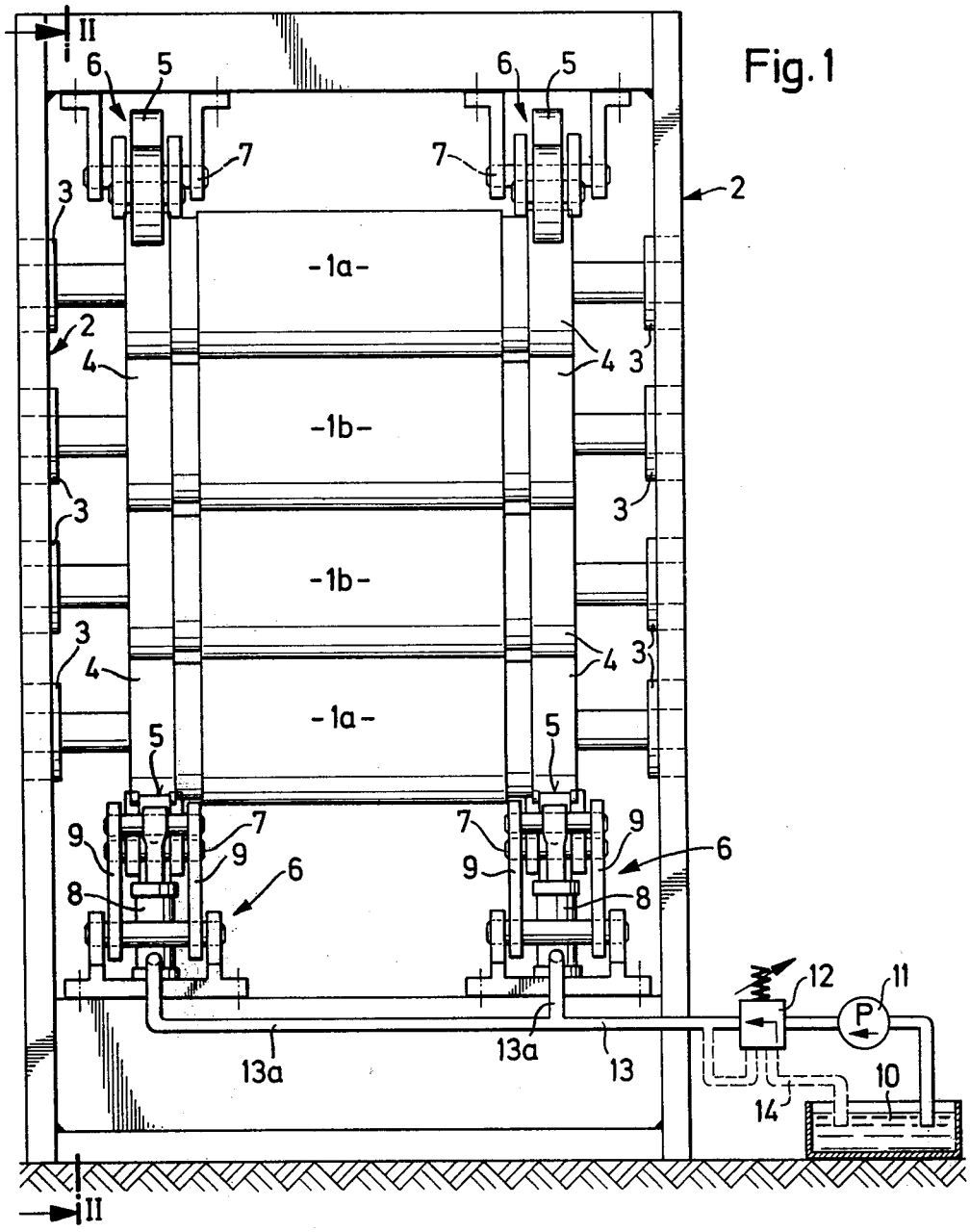

This is a continuation of application Ser. No. 660,313, filed 2/23/76 and now abandoned.

The invention relates to an arrangement for obtaining an equally distributed pressure load in a cylinder stack comprising a plurality of cylinders.

Usually, the compression of a stack of cylinders arranged one above another is difficult to accomplish in such a manner that a pressure force equally distributed in the lengthwise direction of the cylinders be obtained in every cylinder nip. It is known that loaded cylinders bend so that the pressure load is unequally distributed in the cylinder nips. In order to decrease the deflection of the cylinders they can be made stiffer, for instance, by enlarging their outer diameters or by providing them with suitable known deflection-compensating means. However, these solutions are expensive and they are not even applicable in every case.

An object of the invention is to create a device by means of which a relatively equal load distribution is obtained in a simple way in a cylinder stack. The invention is characterized in that a main pressure load occurring in the cylinder stack is provided by short load rollers or corresponding elements which act on the cylinder stack at portions between bearings of the cylinders, thereby transmitting the pressure force directly to the body portions of the outermost cylinders of the stack.

Since the load is not applied to the bearings but directly to the body portions of the cylinders, the pressure load produces a smaller bending moment with respect to the cylindrical portions of the cylinders, and hence, the deflection of the cylinders will be smaller than when the cylinders are loaded at the bearing boxes. Consequently, equality of load distribution is considerably improved, and in most cases it is so much improved that no other measures are required for the equalization of the load distribution.

It has been established that the best load distribution is obtained when the load rollers or the corresponding elements act on the outermost cylinders of the cylinder stack at both ends of the cylindrical surfaces of the cylinders. This is of advantage also because only a part of the total lengths of the cylinders is usually needed for the specific task, which often is of such a nature that the load rollers cannot load those portions of the cylinders.

The invention has proved to be very useful when applied to a printing unit of an offset printing press in which the cylinders are, in the traditional way, provided with bearer rings. In this case, the load rollers are arranged to load the bearer rings of the outermost cylinders of the stack.

To produce a suitable load distribution it is of advantage that the load rollers form loading units comprising two rollers, which units are pivotally journalled so that both rollers of a loading unit load the cylinder stack at least substantially to the same extent. Since there has to be a load at both ends of the cylinder stack, the best solution is to arrange the loading so that at one end of the cylinder stack there is a stationary load roller system and at the other end a movable load roller system, the loading force of the latter being controllable.

Figure 2:
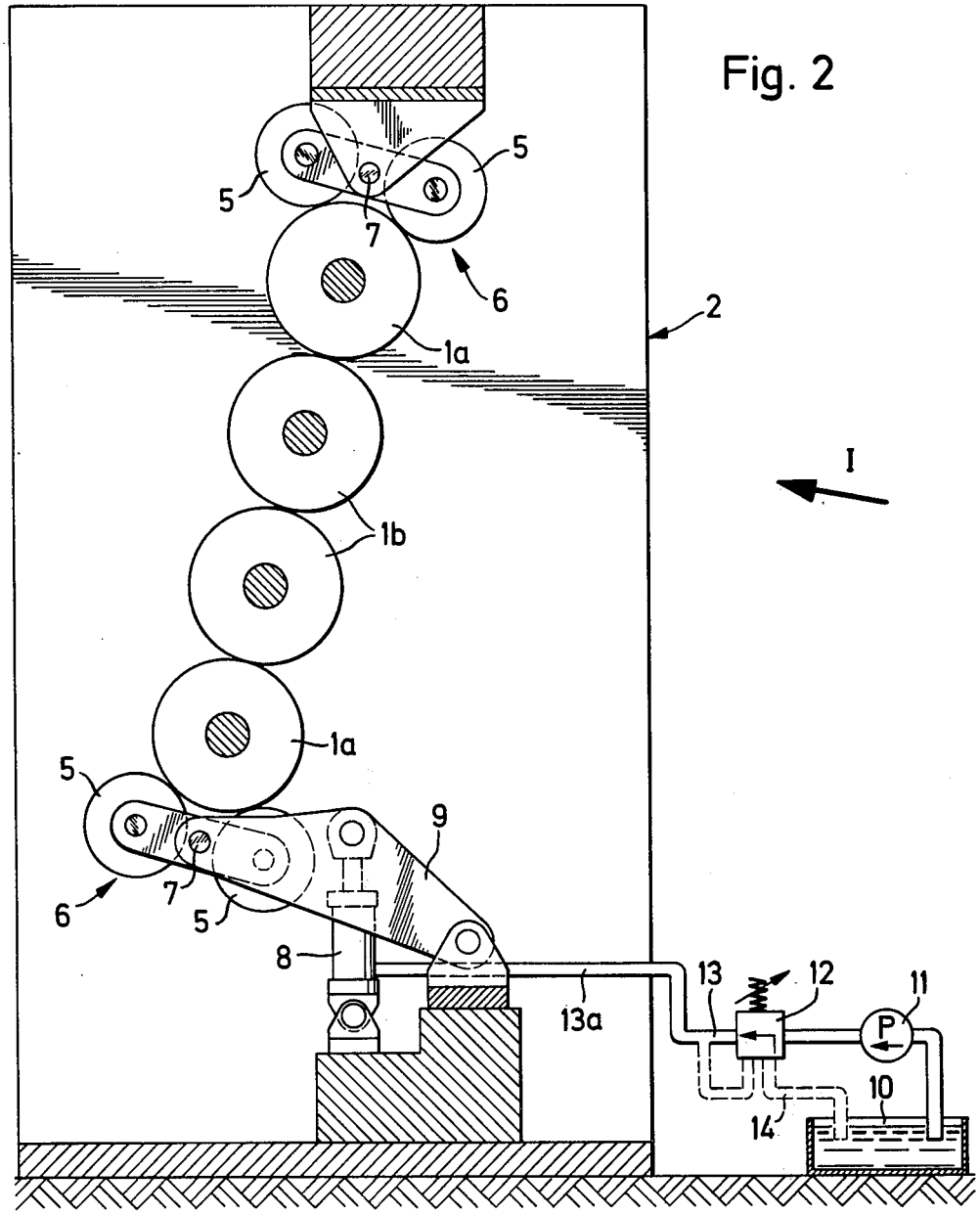

In the following, the invention is described in greater detail with reference to the attached drawings, in which FIG. 1 shows a front view of a printing unit of an offset printing press according to the invention; and FIG. 2 shows the same printing unit seen in the axial direction of its cylinders.

In the drawing, 1*a* and 1*b* indicate cylinders of a printing unit of an offset printing press, 1*a* being plate cylinders and 1*b* blanket cylinders. Numeral 2 indicates a body of the press and 3 bearing boxes of the cylinder bearings which are guided in the body of the press. Each cylinder is provided at both ends with a so called bearer 4, that is a ring which determines with great accuracy the distance between the rotating axes of the cylinders. These bearer rings are loaded by means of load rollers 5 at the upper as well as the lower ends of the cylinder stack 1*a*, 1*b*.

FIG. 2 gives a better view of the actual loading system. The load rollers 5 are joined in pairs to form loading units 6 which are journalled at a point so that both rollers of the unit load the cylinder stack with about the same force. The upper load roller system or unit 6 is stationary but the lower system is movable and its load pressure can be regulated. The loading force is provided by a power cylinder 8, but any other suitable power unit can be used as well. The movable loading unit is attached to a turnable lever 9. There are two of these levers, one at each end of the undermost cylinder. Instead of the levers shown in the Figure, any other movable loading system could be used as well.

There is a hydraulic power system providing the necessary fluid pressure to the cylinders 8. The system comprises a hydraulic fluid container 10, a pump 11, an adjustable pressure regulating valve 12, pressure tubing 13 and return tubing 14. As evident from FIG. 2 the same pressure is fed through tubes 13*a* to the two identical lower loading units 6, whereby the cylinder stack 1*a*,1*b* is loaded with equal forces at both sides.

The invention is not limited to the exemplary embodiment shown, but several modifications are feasible within the spirit and scope of the invention.

I claim:

1. An offset printing press, employing a cylinder stack having a plurality of cylinders; said cylinders defined by at least one plate cylinder and at least one blanket cylinder; bearing rings formed, at the axial ends of the cylinders beyond the off-set plate carrying portion thereof, said rings being adapted to transmit the external load to said cylinders, each of said cylinders being further defined by a cylindrical body portion and stub shafts at the respective ends of said cylinders beyond said bearing rings journalled in bearings; wherein: said assembly being further defined by axially short load rollers for automatically transmitting the entire pressure load to the outermost cylinders of said stack, at both said bearing rings, forming thereby a pressure load, said pressure load being of equal magnitude at each end of the respective cylinders; respective central portions of each of said body portions being free of external load applying means in an axial portion corresponding to said offset plate carrying portion; said stub shafts being free of means applying a substantial external stack-compression load.

2. An offset printing press as defined in claim 1, having loading assembly wherein: said load rollers are formed as units with each including two rollers, said units being pivotally journaled to distribute said pressure load to said cylinder stack to the same extent from both rollers.

3. An offset printing press as defined in claim 2, wherein: said load rollers assembled for loading both ends of said cylinders have means adapted to provide pressure load at opposite ends of a cylinder to load the latter to substantially the same extent.

4. An offset printing press as defined in claim 1, further comprising: a stationary load roller system at one end of said cylinder stack, and a movable load roller system at the other end of said stack, and control means for controlling the loading force of said movable system.

* * * * *